US005895210A

United States Patent [19]

Nakaniwa et al.

[11] Patent Number: 5,895,210

[45] Date of Patent: Apr. 20, 1999

[54] TURBO MACHINE ROTOR MADE OF SHEET METAL

[75] Inventors: Masaru Nakaniwa, Ebina; Kinnosuke Ishibashi, Fujisawa; Takanori Shiozuka, Kunitachi; Kouichi Umezawa, Sagamihara, all of Japan

[73] Assignee: Ebara Corporation, Tokyo, Japan

[21] Appl. No.: 08/803,522

[22] Filed: Feb. 20, 1997

[30] Foreign Application Priority Data

Feb. 21, 1996 [JP] Japan ..... 8-058302

[51] Int. Cl.[6] ..... F01C 1/18; F01C 21/08

[52] U.S. Cl. ..... 418/179; 418/206.5; 418/206.9; 29/888.023

[58] Field of Search ..... 418/179, 206.1, 418/206.5, 206.9; 29/888.023

[56] References Cited

U.S. PATENT DOCUMENTS

| | | | |
|---|---|---|---|
| 571,770 | 11/1896 | Kurz | 418/206.5 |
| 1,030,083 | 6/1912 | Green | 418/206.5 |
| 2,944,732 | 7/1960 | Lorenz | 418/206.5 |
| 5,320,508 | 6/1994 | Kiefer | 418/206.5 |

FOREIGN PATENT DOCUMENTS

| | | | |
|---|---|---|---|
| 415 864 | 7/1925 | Germany . | |
| 696 500 | 9/1940 | Germany . | |
| 810 419 | 8/1951 | Germany . | |
| 59-131789 | 7/1994 | Japan . | |
| 44457 | 4/1961 | Poland | 418/206 |

*Primary Examiner*—John J. Vrablik
*Attorney, Agent, or Firm*—Armstrong, Westerman, Hattori, McLeland & Naughton

[57] ABSTRACT

A rotor with lobes for use in a turbomachine having a rotation shaft is disclosed. The rotor comprises a rotor shell having a shell member, which is made of a sheet strip metal and having profile curvatures to conform to a required shape of the lobe of the rotor, and a connecting portion for connecting the rotor to the rotation shaft. By making a rotor from a sheet strip metal through bending process to form a rotor shell, a rotor having thin walls can be produced efficiently and economically to provide a light weight rotor of reduced inertial moment so that the startup process or shut down process can be performed quickly.

18 Claims, 10 Drawing Sheets

TURBO MACHINE ROTOR MADE OF SHEET METAL

BACKGROUND OF THE INVENTION

1. Field of the Invention

The present invention relates in general to rotors for use in turbomachines, such as displacement type vacuum pumps or compressors operating in dry state, i.e., without using lubricant in the fluid passages, and relates also to a method of manufacturing such rotors.

2. Description of the Related Art

There are turbomachines of displacement type vacuum pumps and compressors comprising a pair of rotors, each of which has lobes with an involute or cycloid peripheral profile. The rotors are synchronously rotated so that the lobes of each rotor are engaged with that of the other rotor thereby for pressurizing and transporting fluid.

Conventional rotors generally have been made as a unitary solid part. Those solid rotors are manufactured, for example, by casting the rotor and rotation shafts as an integral unit, or by an insert casting around the rotation shaft, or by mechanically fixing a solid rotor to a rotation shaft by a keyed arrangement.

However, such solid rotors are heavy to result in inefficiencies in fabrication and assembly operations, as well as a high material cost. Further, since these rotors have a high inertial moment, they cannot be accelerated or decelerated quickly during the startup or stopping operation. Other problems relate to the possibility of damaging the casing should the rotating rotor fail by fracture, and to the difficulty in dynamic balancing because of non-uniformness of the surface of the rotor.

Techniques to produce hollow rotors have been developed comprising lamination process of punched sheet metals, but this approach presents a productivity problem because of the difficulty of bonding of the laminates, and the cost of assembly tends to be high. For this reason, there has also been a suggestion to produce hollow rotors by making hollow sections inside the rotors, as disclosed in Japanese Patent Application, First Publication H7-151082, for example.

However, the approach disclosed in Japanese Patent Application First Publication No. H7-151082 presents a limitation in reducing the weight, because the rotors are made by casting which creates a limit on the wall thickness reduction achievable. The approach also presents another problem regarding uniformness of the wall thickness because of the limitations inherent in the casting technique.

Therefore, there has been a need to provide light weight and low inertial rotors for use in turbomachines, which can be produced efficiently and at low cost, and an accompanying need for a new method of production of such rotors.

SUMMARY OF THE INVENTION

It is an object of the present invention to provide a light weight rotor for turbomachines which can be manufactured efficiently and economically. The object has been achieved in a rotor with lobes for use in a turbomachine having a rotation shaft. The rotor comprises a rotor shell having a shell member, which is made of a sheet strip metal and having profile curvatures to conform to a required shape of the lobe of the rotor, and a connecting portion for connecting the rotor to the rotation shaft.

According to the rotor presented, by making a rotor from a sheet strip metal through bending process to form a rotor shell, a rotor having thin walls can be produced efficiently and economically to provide a light weight rotor of reduced inertial moment so that the startup process or shut down process can be performed quickly.

An aspect of the basic rotor is that the seam section fabricated between the shell member is offset away from the apex of the lobe formed by joining the shell members. By disposing the seam sections away from the apex of the lobe of the rotor, the seam of the fabricated rotor which is most vulnerable to surface irregularities are prevented from contacting the inner surface of the rotor casing, thereby maintaining seal effect therebetween, and assuring a high performance of the rotor.

Another aspect of the invention is that reinforcing member in the form of a pin or plate is disposed between the rotation shaft and the rotor shell. According to this aspect of the rotor, the reinforcing member reaches from the rotation shaft to the inner surface of the rotor shell serving to provide internal reinforcement for the assembled rotor shell, thus preventing a possibility of distortion of the rotor during its operation. The reinforcing member may be formed as a pin or plate connecting the rotor shell to the rotation shaft, or a suitable rib member.

Another aspect of the invention is a method of making a light weight rotor. The steps comprise: bending one or a plurality of shell members made of sheet strips to conform to a required profile of a shape of a rotor lobe; abutting the shell members to form a rotor shell and making seams; and attaching the rotor shell to the rotation shaft through a connecting portion.

The method enables the production of rotors efficiently at low cost by the application of a simple forming method such as press forming to produce a number of shell members.

DESCRIPTION OF THE PREFERRED EMBODIMENTS

Figure 1:
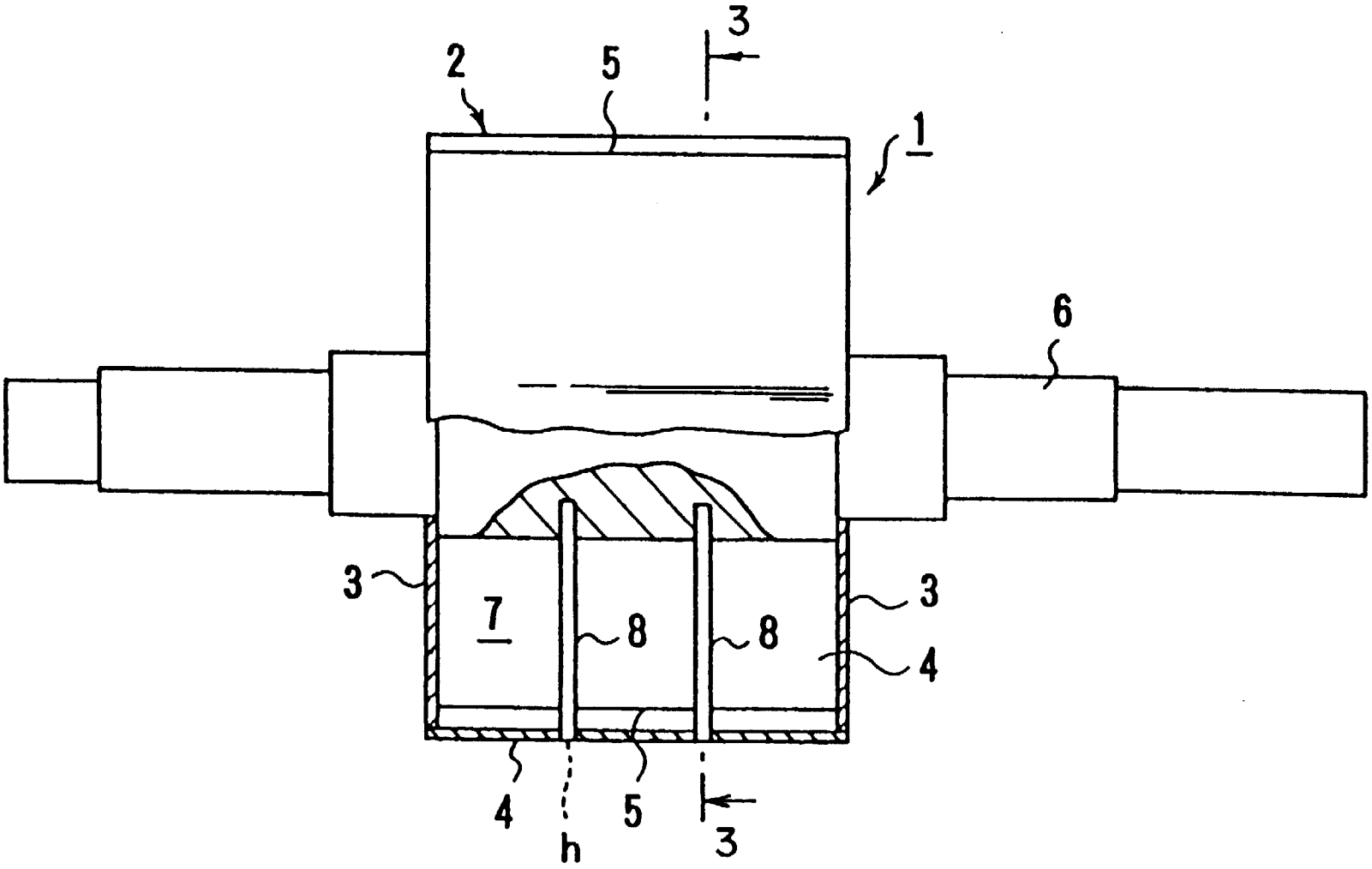
FIG. 1 is a partially broken-out plan view of a first embodiment of the rotor of the present invention.

In the following, preferred embodiments will be explained with reference to the attached drawings. FIGS. 1 to 3 show a rotor 1 of a first embodiment of the invention, which is for use for a "two lobe type" rotary pump. Rotor 1 comprises: a rotor shell 2 which is made by bending a sheet or a plate of metal material, such as stainless steel strip, into a desired profile of the lobes L, such as an involute curve or a cycloid curve; and a pair of side plates 3 which close off the open ends of the rotor shell 2.

Figure 2:
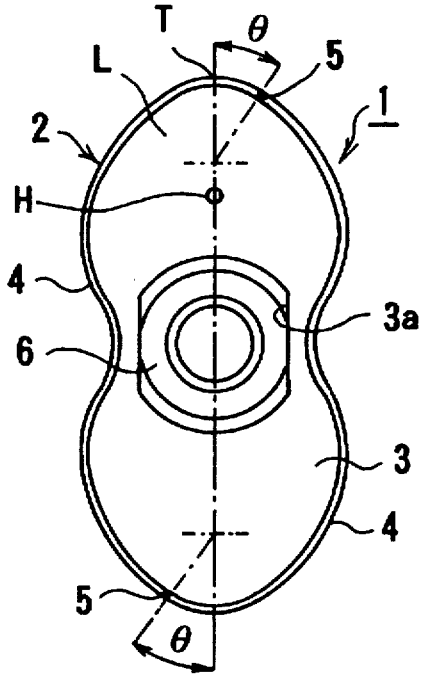
FIG. 2 is a side view of the rotor shown in FIG. 1.

The rotor shell 2 is assembled into a unit body by arranging two shell members 4 of a same shape by abutting the edge of each other and joining the abutting surfaces by welding, for example. As shown in FIG. 2, the seam section 5 extends in the axial direction of the rotor shaft, and is offset from the apex T of a lobe L of the rotor 1 by an angle θ. The apex of the lobe is close to the inner surface of a casing of a rotary pump or the surface of the other rotor with a small distance thereby determining the compressing or discharging capacity of the pump. By offsetting the seam section 5 of the shell member 4, which is susceptible to having surface irregularities, away from the apex of the lobe of the rotor 1, a tight sealing effect is maintained to keep a high pumping performance.

In the embodiment, since the rotor shell 2 is made by joining two pieces of shell member 4, it is not necessary to bend a large piece of plate or sheet material a number of times, thus resulting in a high efficiency in shaping process and a high precision of working. Since each shell member is formed to correspond with a lobe of the rotor, each shell member 4 can be of a same shape and size, thus working process or stock management is simplified. The shell member 4 can have any form of the rotor other than the "half-split" shape. It can be of a single plate or of a multi-split shape.

The side plate 3 is made by such methods as press working to have an outer profile matching the inner profile of the rotor shell 2, and is provided with an elongated shaft hole 3*a* having two straight portions. The rotation shaft 6 is inserted into the shaft hole 3*a* and firmly fixed to the side plate 3 by abutting the straight portion with cut-out section thereof by some joining means such as welding. An air hole H is formed on the side plate 3 to prevent pressure difference between the inner and outer spaces of the rotor 1.

Figure 3:
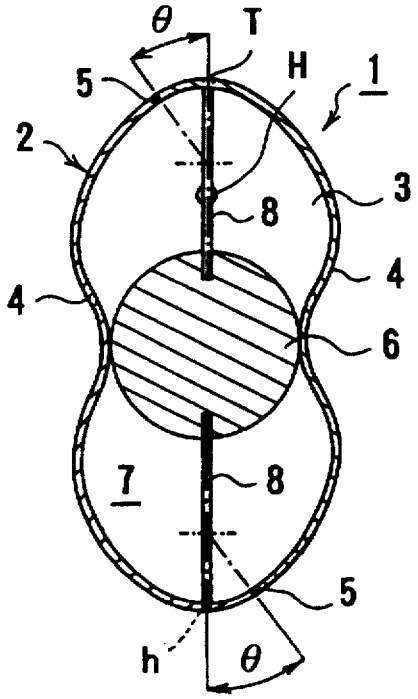
FIG. 3 is a cross-sectional view of the rotor through a plane 3—3 in FIG. 1.

As shown in FIG. 3, a series of reinforcing pins 8 are provided between the rotation shaft 6 and the rotor shell 2, with a predetermined distance along the axial direction of the shaft 6. The reinforcing pins 8 are arranged at right angle to the shaft axis of the rotor shell 2. One end of the reinforcing pin 8 is firmly attached to the rotation shaft 6, and the opposite end reaches the apex T of the lobe L of the rotor shell 2 to be attached thereto by joining means such as welding. The reinforcing pins 8 connect the rotor shell 2 and the rotation shaft 6 to reinforce the rotor shell 2 thereby to prevent deformation of the rotor shell 2 to maintain the pump performance and increase the service life.

Figure 4A:
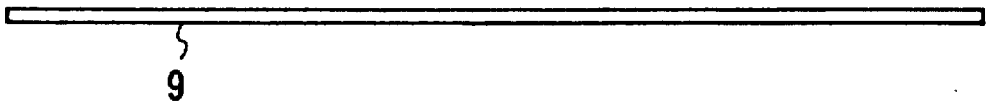
FIGS. 4A through 4E are illustrations of the steps for bending a rotor shell member.
Figure 4B:
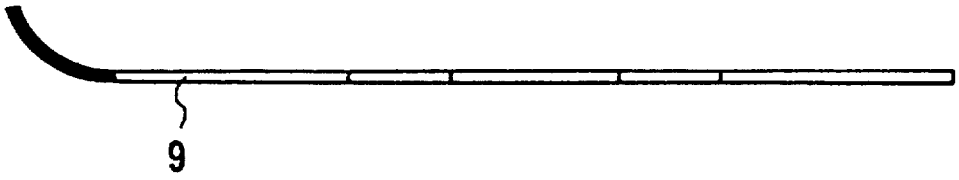
Figure 4C:
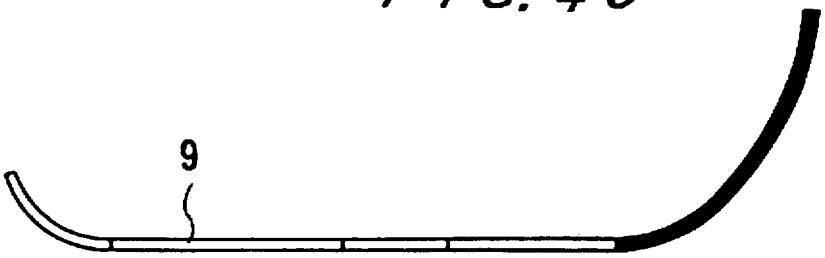
Figure 4D:
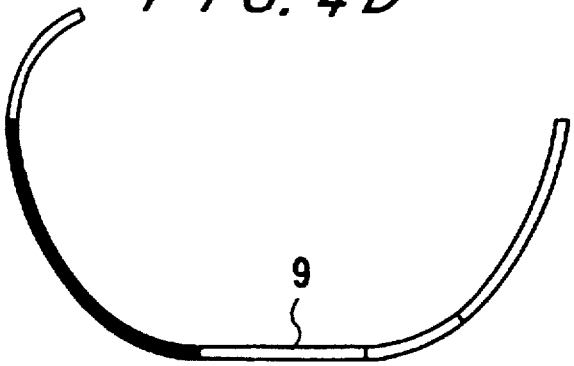
Figure 4E:
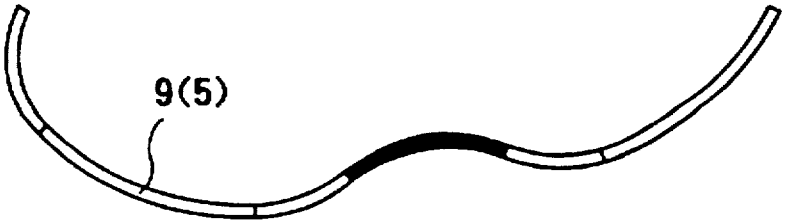

A method of manufacturing the rotor 1 will be explained in detail. First, the bending process of the shell member 4 will be described with reference to FIG. 4. As shown in FIG. 4A, a rectangular shaped blank 9 of given dimensions is prepared by a fabrication method such as press working. One end of the blank 9 is subjected to a first bending operation to give it a shape as shown in FIG. 4B, then, the opposite end is subjected to a second bending operation as shown in FIG. 4C. These steps are followed by a third bending operation to the mid-section of the shell member 4 as shown in FIG. 4D, followed by a fourth bending operation as illustrated in FIG. 4B to progressively produce the desired shape for a shell member 4.

Two pieces of the shell member 4 are butted against each other in a manner that one member 4 is rotated 180° to the other, and the seam sections 5 are joined together by such means as arc welding to produce an open ended rotor shell 2. Holes h for securing the reinforcing pins 8 are or have been fabricated on the rotor shell 2 at or until this stage.

Figure 5A:
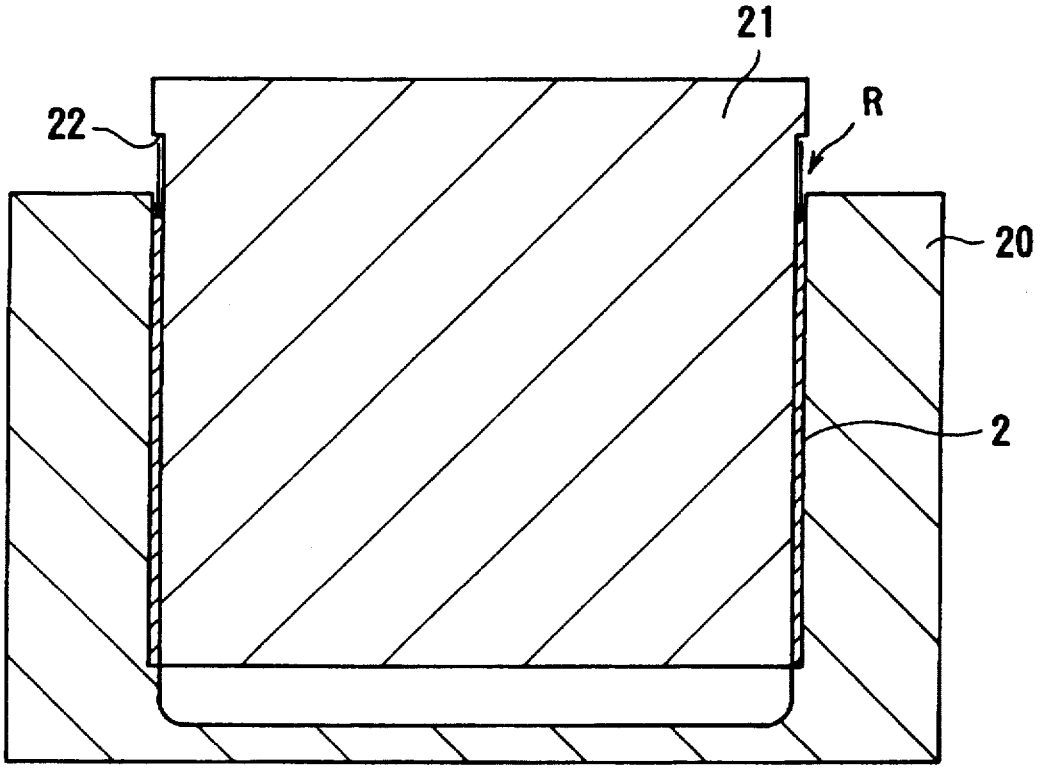
FIGS. 5A and 5B are illustrations of the method and apparatus for restriking a rotor shell.
Figure 5B:
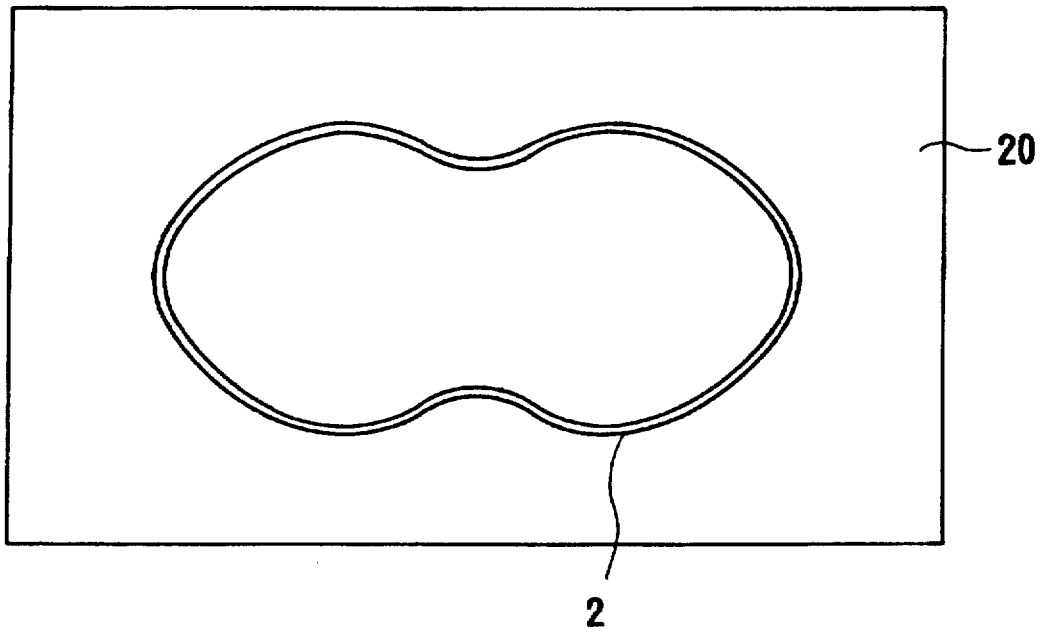

Next, the rotor shell 2 is now restriken through a restriking operation by using a die 20 and a punch 21 as shown in FIG. 5. The die 20 and punch 21 have a cross section of a rotor and a space R for receiving the rotor 3 therebetween when they are engaged to each other as shown in FIG. 5A. The punch 21 has a taper progressively narrowing toward its distal end and a step face 22 at its proximal end for pressing the end face of the rotor shell 3.

In the restriking process, the rotor shell 2 is put into the die 20 and the punch is lowered into the die to the inside of the rotor shell 2. The punch 21 is smoothly inserted into the rotor shell 2 by function of its taper, and the rotor shell 2 is pressed against the die 20. The punch is further inserted until the step face 22 thereof abuts the end face of the rotor shell 2. A predetermined pressure is exerted on the rotor 2 high enough to prevent a spring back of the shape, thus providing a precision processing on the rotor shell 3.

The side plates 3 are produced in advance to have an outer profile corresponding to the inner profile of the rotor 2 and a shaft hole by such means as press working, and are attached to a selected location of a pre-fabricated rotation shaft 6 by such means as arc welding. Next, the assembled rotation shaft 6 is placed on the inside of the rotor shell 2 so that the side plates 3 are fitted suitably to the open ends of the rotor shell 2. The abutting regions of the rotor shell 2 and the side plates 3 are joined together by such means as laser welding.

Subsequently, a reinforcing pin 8 is inserted through the hole h on the rotor shell 2 so that one end of the reinforcing pin 8 reaches the rotation shaft 6 and is attached to the shaft 6 by threading, for example. The opposite end of the reinforcing pin 8 is then attached to the rotor shell 2 by such joining means as arc welding to connect the rotor shell 2 to the rotor shaft 6. The process is repeated for other reinforcing pins 8, and then the welded surfaces are finished.

Figure 6:
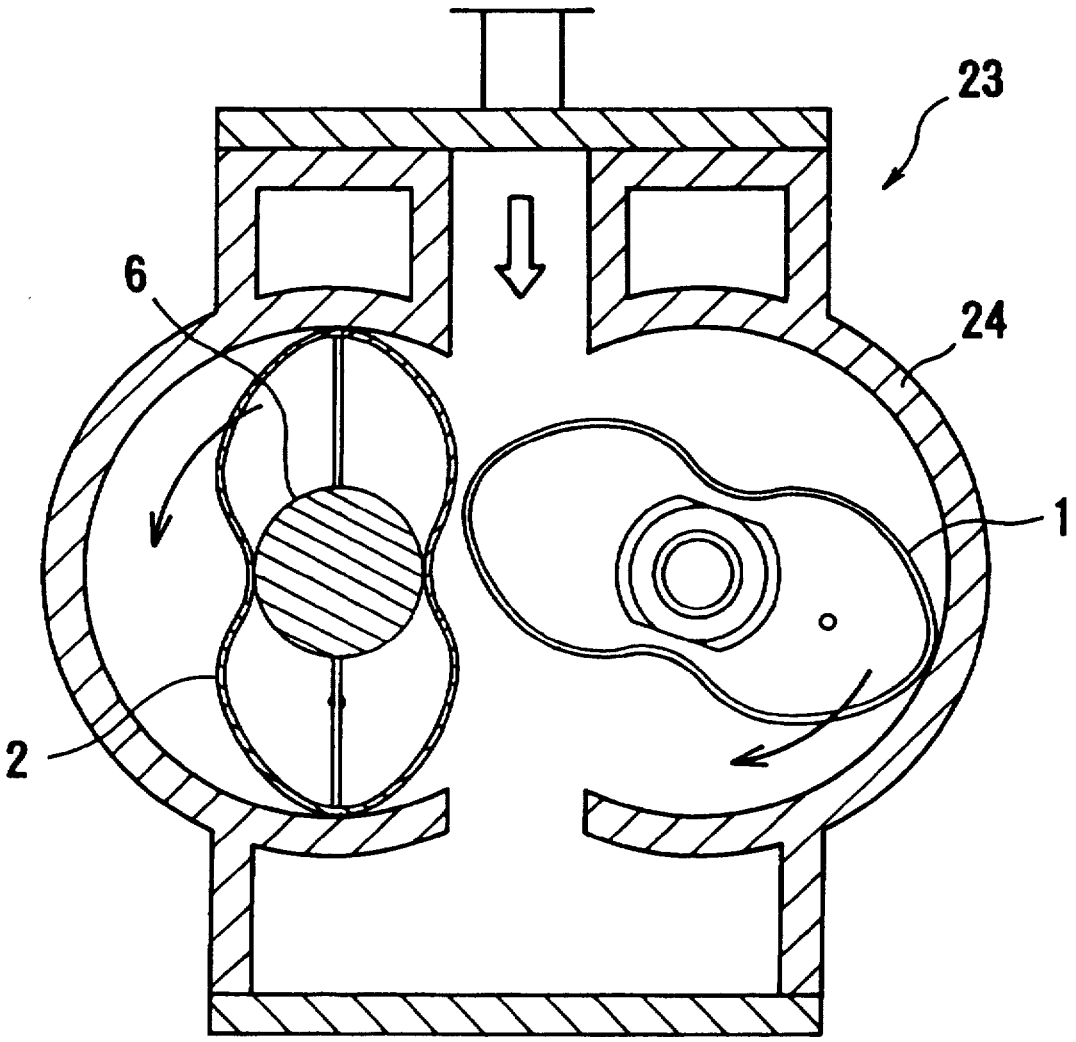
FIG. 6 is a front cross-sectional view of a rotary pump utilizing the rotor of the first embodiment.
Figure 7:
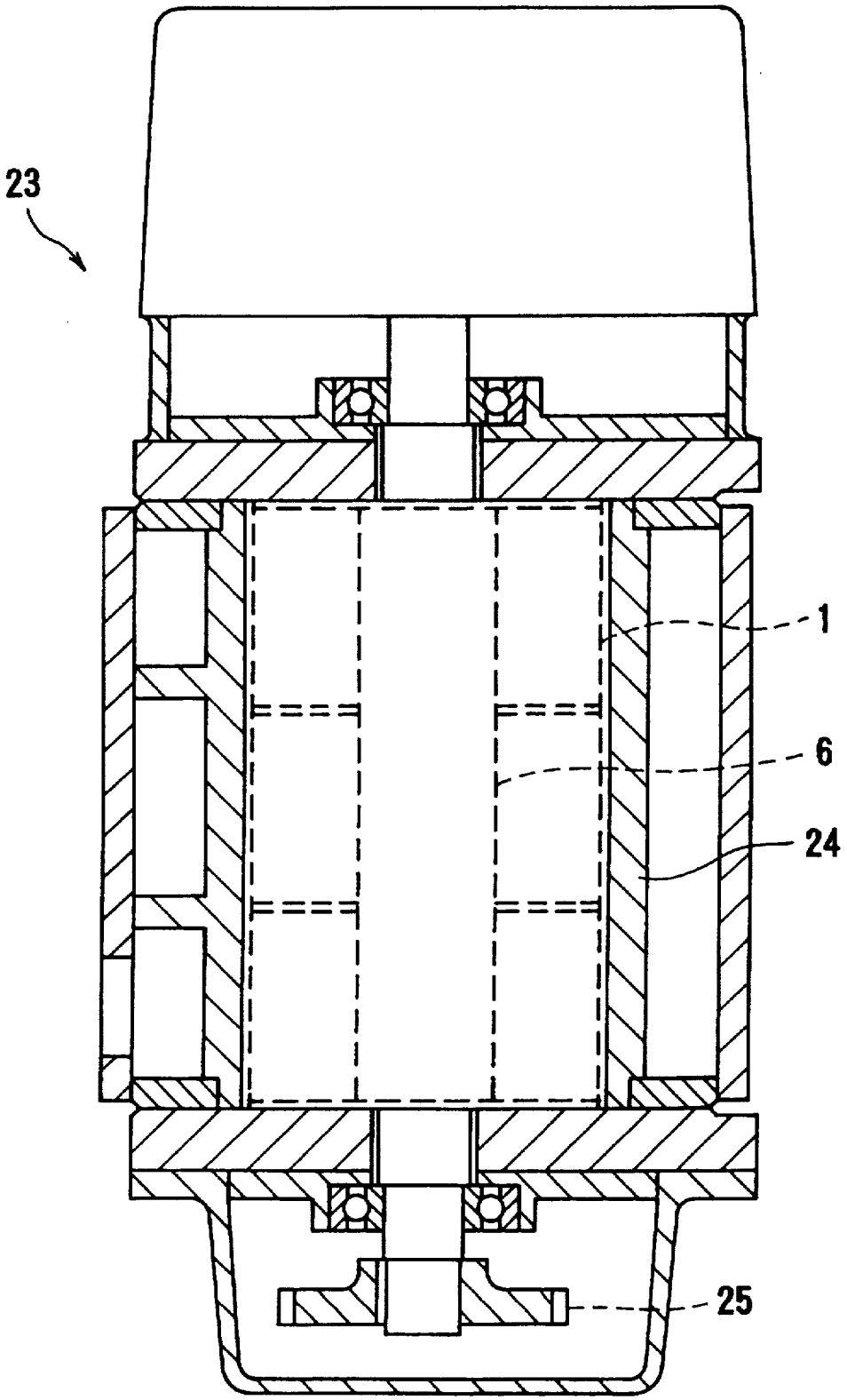
FIG. 7 is a plan cross sectional view of the rotary pump of FIG. 6.

FIGS. 6 and 7 show an embodiment of a rotary pump 23 using the above-described rotor 1. The rotary pump 23 comprises two parallel shafts 6 synchronously rotating through a gear engagement 25, each shaft 6 having a rotor shell 2 attached thereto with a predetermined angle of phase difference to each other.

The above described rotary pump has rotors 1 having a hollow section 7 to lead to a lighter weight than the conventional rotor and a reduced moment of inertia, which means that the driving means such as an electric motor for rotating the rotor can be of less capacity, and that a quick start or stop is possible in the operation. Since air holes H provided on the side plates 3 cancel the pressure difference between the inner and outer spaces of the rotor 2, the rotor 1 does not suffer any deformation problems during pump operation.

Figure 8B:
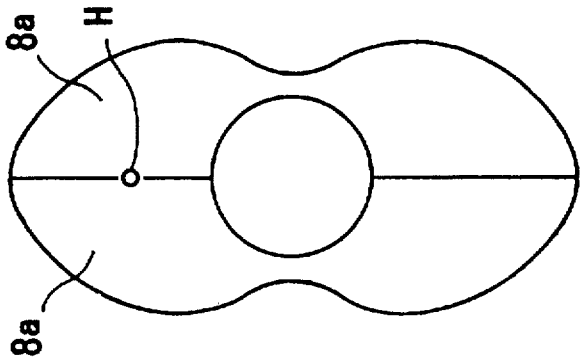
FIG. 8B shows a reinforcing plate.
Figure 8A:
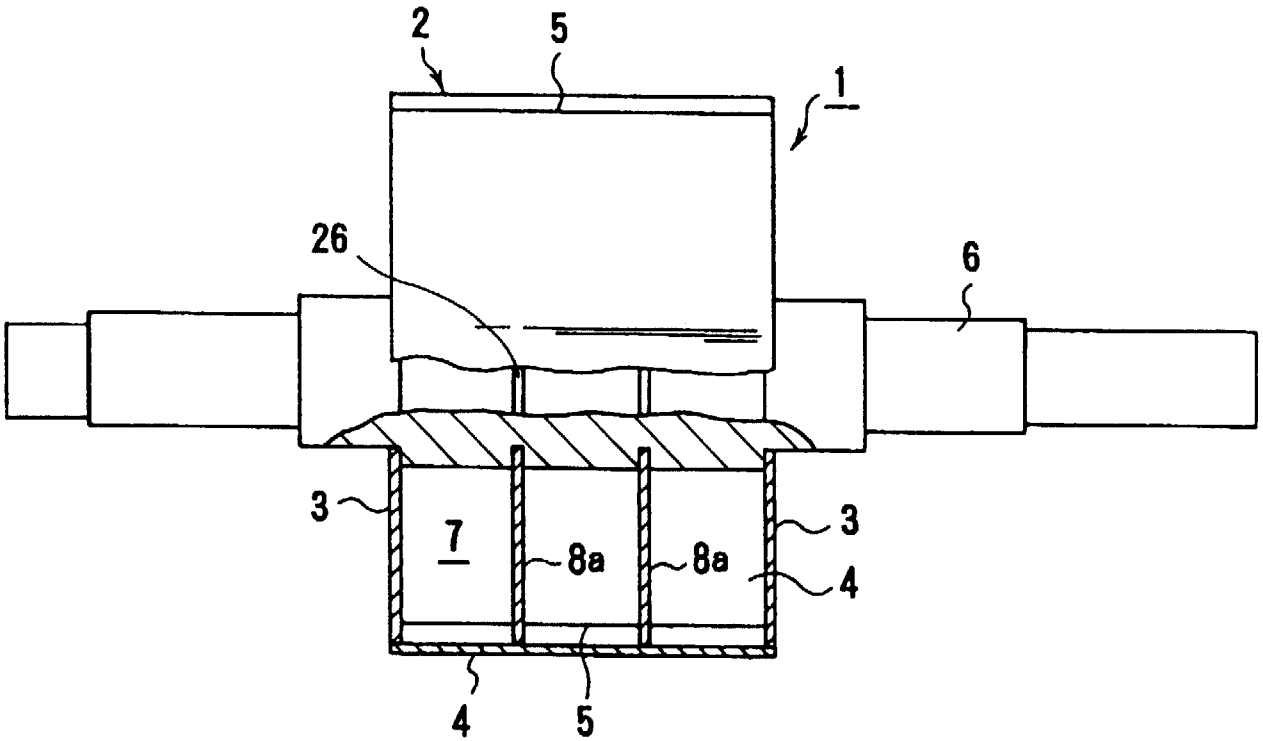
FIG. 8A is the rotor of a second embodiment of the present invention.

FIG. 8 shows another embodiment of the present invention, in which reinforcing plates 8*a* are arranged in place of reinforcing pins 8 in the embodiment of FIG. 1. The reinforcing plates are shaped to have an inner profile of the rotor shell 2, i.e., the same as the side plates 3, and divided into two parts. The reinforcing plates are attached to the rotation shaft 6 by being fitted into a circumferential groove 26 formed on the shaft 6. The reinforcing plates 8*a* also have air holes H for preventing pressure difference. It is preferable to fix reinforcing plates 8*a* to each other or to the rotor shell 4 by joining means such as laser welding for a stable construction.

Figure 9:
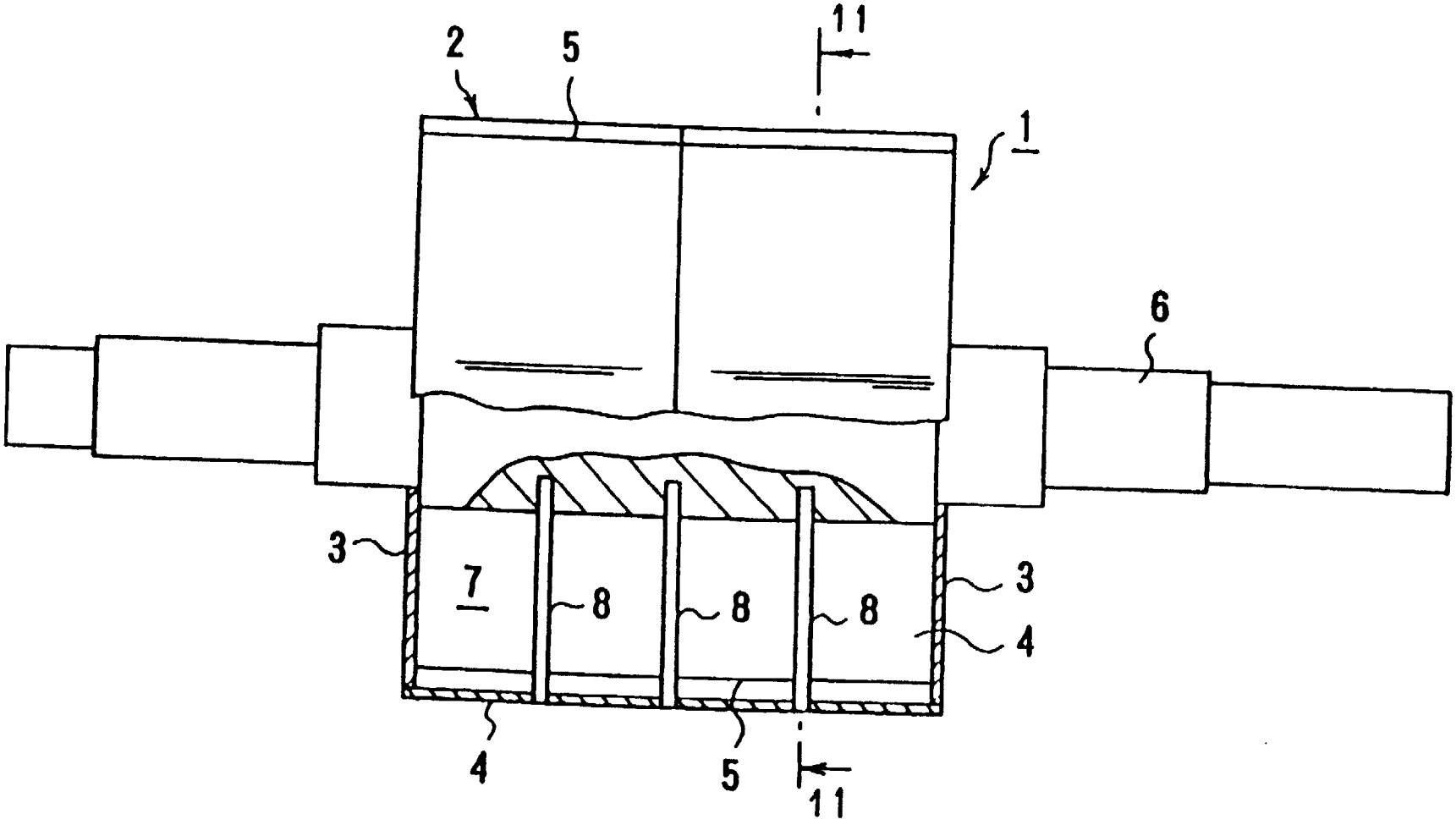
FIG. 9 is a partially broken-out illustration of a third embodiment of the present invention.

FIG. 9 shows another embodiment of the invention suitable for manufacturing large rotors. When manufacturing a rotor 1 of a large size for use in a large capacity pump by conventional casting method, it is necessary to provide a mold of a large size leading to a lower manufacturing efficiency. In this embodiment, the rotor shells 2 are pre-assembled as unit modules in advance by the process explained previously with reference to FIGS. 4 and 5, and a long rotor shell 2 is manufactured by joining a plurality of the shell unit (two pieces in the illustrated embodiment) in an axial direction.

In this method, it is preferable to join the rotors 1 by welding, however, it is not inevitable as long as sealing effect is secured at the connecting portions. By providing several types of rotor shell unit having different lengths, various length of rotor 1 can be manufactured by different combination.

Figure 10:
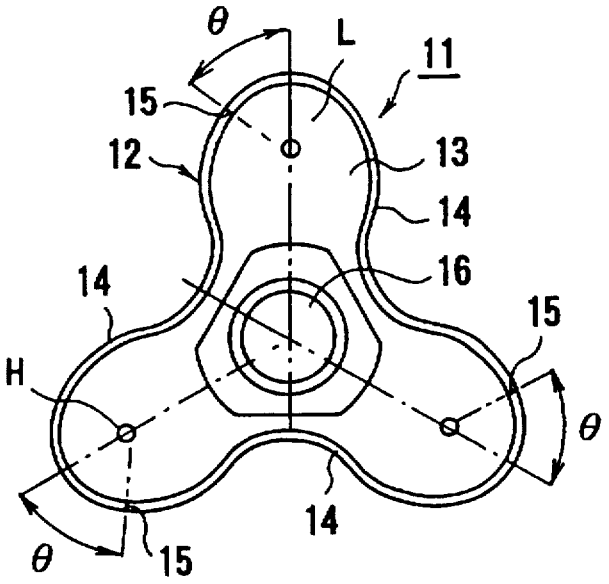
FIG. 10 is a side view of a rotor of the fourth embodiment of the rotor of the present invention.
Figure 11:
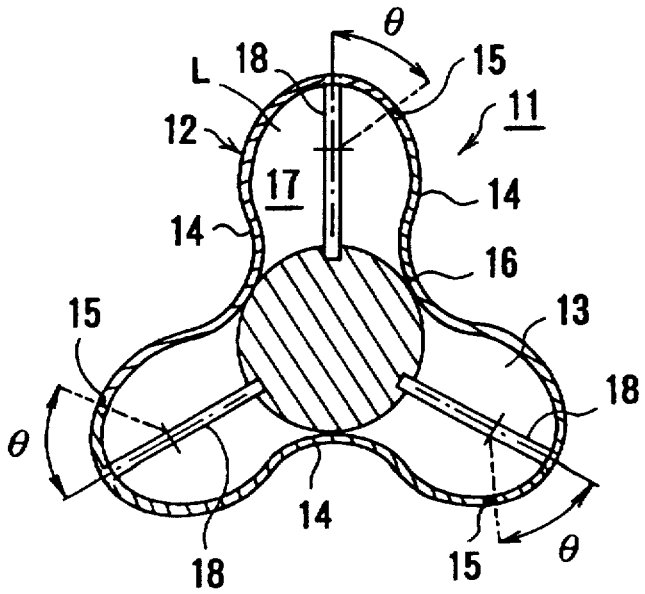
FIG. 11 is a cross-sectional view of the embodiment of FIG. 10.
Figure 12:
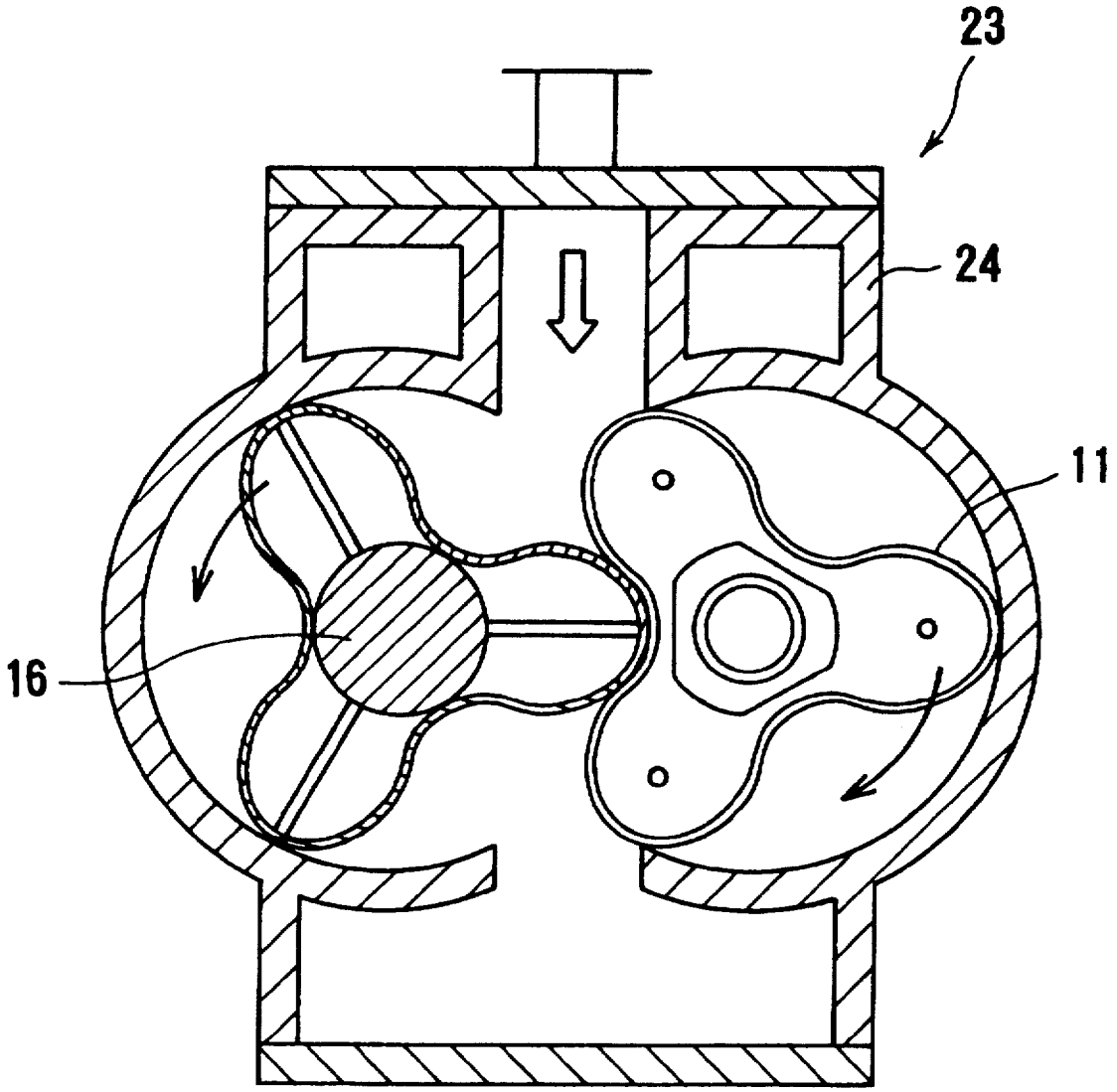
FIG. 12 is a cross-sectional view of a rotary pump utilizing the rotor of FIG. 10.

FIGS. 10 to 12 show an example of the so-called "three lobe type" rotor which can be produced by the process of the present invention.

Rotor 11 is comprised of a rotor shell 12 having three lobes and a pair of side plates 13 for closing the open ends of the rotor shell 12. The rotor shell 12 is constituted by three pieces of shell members 14 which are abutted against each other and joined together at the seam sections 15 to produce an integrated rotor shell 12 having three lobes L.

Similar to the first embodiment, the seam sections 15 of the rotor shell 12 are offset by an angle θ from the apex T, as shown in FIGS. 10 and 11, and the rotor shell 12 is attached as a unit to the side plates 13, through the rotation shaft 16, to provide a hollow interior space 17 between the rotor shell 12 and the rotation shaft 16.

Because the rotor 11 of this embodiment has three lobes L, each of the lobes L is internally reinforced by reinforcing pins 18 which extend out from the rotation shaft 16 to the apexes T in a three-fold symmetry.

It has been clearly demonstrated in the foregoing that by making a rotor 1 from a sheet metal material through bending process to form a rotor shell 2, a rotor having thin walls can be produced efficiently and economically to provide a light weight rotor of reduced inertial moment so that the startup process or shut down process can be performed quickly.

The manufacturing process is simple and precise, and the material costs are relatively low, thus producing the overall effect of a high productivity process at low production cost.

Since the rotor shell 2 and the side plates 3 are made from the sheet metal material which is commercially available, material cost is cheap. Further, manufacturing process is comprised of bending processes and welding processes, the manufacturing cost is also cheap.

Since those mechanical manufacturing processes can provide a products of a high precision, the rotor 1 thus made can produce a high performance rotary pump of a high compression rate.

What is claimed is:

1. A rotor with lobes for use in a turbomachine having a rotation shaft, said rotor comprising:

a rotor shell having a shell member including end faces, said shell member being a sheet strip metal having profile curvatures which conform to a required shape of said lobes of said rotor;

said sheet metal strip containing at least one seam section for seaming said end faces of said shell member, said seam section being offset away from an apex of each of said lobes of said rotor; and a connecting portion for connecting said rotor to said rotation shaft.

2. A rotor as according to claim 1, wherein said rotor shell has a plurality of said shell members, each of said shell members having a circumferentially split shape of said rotor shell.

3. A rotor as according to claim 1, wherein a plurality of said rotor shells are connected in an axial direction.

4. A rotor as according to claim 1, wherein said connecting portion comprises side plates for covering open end sections of said rotor shell.

5. A rotor as according to claim 4, wherein said side plates have an air hole.

6. A rotor as according to claim 1, further comprising a reinforcing member for reinforcing said rotor shell arranged inside said rotor shell.

7. A rotor as according to claim 6, wherein said reinforcing member is a pin bridging said rotor shell and said rotation shaft.

8. A rotor as according to claim 6, wherein said reinforcing member is a plate having an outer profile conforming to the inner profile of said rotor shell.

9. A rotor with lobes for use in a turbomachine having a rotation shaft, said rotor comprising:

a rotor shell having a shell member including end faces, said shell member being a sheet strip metal having at least one seam section for seaming said end faces of said shell member, said seam section being offset away from an apex of each of said lobes of said rotor, and having profile curvatures to conform to a required shape of said lobe of said rotor; and side plates for covering open end sections of said rotor shell.

10. A rotor as according to claim 9, wherein said side plates have an air hole.

11. A rotor as according to claim 9, further comprising a reinforcing member for reinforcing said rotor shell arranged inside said rotor shell.

12. A rotor as according to claim 11, wherein said reinforcing member is a pin bridging said rotor shell and said rotation shaft.

13. A rotor as according to claim 11, wherein said reinforcing member is a plate having an outer profile conforming to the inner profile of said rotor shell.

14. A rotary pump comprising a rotor with lobes attached to a rotation shaft, said rotor comprising:

a rotor shell having a shell member including end faces, said shell member being a sheet strip metal having at least one seam section for seaming said end faces of said shell member, said seam section being offset away from an apex of each of said lobes of said rotor, and having profile curvatures to conform to a required shape of said lobe of said rotor; and a connecting portion for connecting said rotor to said rotation shaft.

15. A rotor as according to claim 14, wherein said side plates have an air hole.

16. A rotor as according to claim 14, further comprising a reinforcing member for reinforcing said rotor shell arranged inside said rotor shell.

17. A rotor as according to claim 16, wherein said reinforcing member is a pin bridging said rotor shell and said rotation shaft.

18. A rotor as according to claim 16, wherein said reinforcing member is a plate having an outer profile conforming to the inner profile of said rotor shell.

* * * * *